United States Patent [19]

Mims

[11] Patent Number: 4,519,378

[45] Date of Patent: May 28, 1985

[54] HEATING DEVICE

[76] Inventor: Philip B. Mims, P.O. Box 36, Lorton, Va. 22079

[21] Appl. No.: 292,539

[22] Filed: Aug. 13, 1981

[51] Int. Cl.[3] ..... F23G 3/00

[52] U.S. Cl. ..... 126/225; 126/165

[58] Field of Search ..... 126/225, 222, 224, 135, 126/136, 140, 153, 163, 164, 165, 110 A, 110 D, 110 E, 298, 25 R

[56] References Cited

U.S. PATENT DOCUMENTS

| | | | |
|---|---|---|---|
| 1,997,192 | 4/1935 | Kasamis | 126/25 R |
| 2,718,845 | 9/1955 | Dudley | 126/25 R |
| 2,774,345 | 12/1956 | Peplin | 126/25 R |
| 3,220,400 | 11/1965 | Yager | 126/140 |
| 3,307,532 | 6/1965 | Hume | 126/165 |
| 3,952,721 | 4/1976 | Patterson | 126/126 |
| 4,026,264 | 12/1974 | Henriques | 126/126 |
| 4,299,197 | 11/1981 | Turley | 126/165 |

FOREIGN PATENT DOCUMENTS

| | | | |
|---|---|---|---|
| 453809 | 9/1936 | United Kingdom | 126/104 A |

*Primary Examiner*—Larry Jones

*Assistant Examiner*—Noah Kamen

[57] ABSTRACT

A heating device constructed for efficiently burning newspapers by converting them to a carbon-like material and then burning this material in a controlled manner to produce useful heat including radiant heat which may be employed to heat a living space, persons occupying the space, cooking foods, or the like. In one embodiment, the heating device is placed in a fireplace and in a second embodiment encompassed by this invention, the heating device is a free-standing heating device which may be used indoors or outdoors. The heating device includes a supporting structure for supporting folded newspapers in a housing having an open front with the newspapers being retained in place by side pressure exerted by damper screen supporting rods indented into the side edges of the newspapers. The upper end of the housing has an opening communicating with a fireplace chimney, smokestack, or the like, and the lower end of the housing is provided with a draft providing arrangement including a forced air draft which may be controlled to provide appropriate combustion supporting air for efficient burning of the newspapers without residue.

6 Claims, 5 Drawing Figures

HEATING DEVICE

FIELD OF THE INVENTION

The present invention relates to heating devices and, more particularly, a heating device for consuming newspapers which are normally disposed of as waste material by converting them from a volume or thickness of approximately ½" of newspaper to approximately twelve times that volume of a carbon-like material and burning this material at a controlled rate with the heating device being insertable into a fireplace, or capable of use in a free-standing mode and including a housing, a structure for supporting folded newspapers in a suspended manner in the housing which includes an expanded metal rate of combustion control member engaging the front surface of the newpapers and a controlled draft device for supplying combustion supporting air to the newspapers when necessary.

DESCRIPTION OF THE PRIOR ART

Various types of devices have been utilized in fireplaces, and the like, as heating devices and the use of a fireplace appliance for burning newpapers has been proposed in U.S. Pat. No. 3,307,532, issued Mar. 7, 1967, which involves primarily a supporting rod positioned in a fireplace with newspapers suspended over the supporting rod, which arrangement provides very little control over the rate of combustion of the newspapers and also fails to provide combustion supporting air when necessary.

SUMMARY OF THE INVENTION

It is an object of the present invention to provide a heating device for consuming newpapers by converting them to carbon-like material and slowly burning this material and which includes an open front, generally vertically disposed housing having an open upper end which may be positioned within a fireplace or connected with a smokestack for discharge of smoke and other products of combustion. The heating device has the ability to increase by approximately twelve times the volume of the basic fuel such as waste newspapers and the like.

Another object of the invention is to provide a heating device, in accordance with the preceding object, in which the housing is provided with a supporting structure for suspending newspapers within the housing which includes a movable screen mesh member overlying the outer surface of the newspapers for confining the newspapers between the screen mesh member and the rear of the housing for retaining the integrity of the newspapers during burning and controlling the burning rate thereof to maintain a relatively slow burning rate to convert the newspaper to carbon-like material which burns slowly to produce substantial radiant energy for heating persons in a living space or surrounding surface areas or cooking foods, or the like.

A further object of the invention is to provide a heating device, in accordance with the preceding objects, in which the housing is provided with a forced air draft device and an adjustable control therefor for varying the discharge of combustion supporting air along the bottom edge portion of the newspapers when combustion supporting air in addition to that provided by normal air convection is required.

Still another important object of the invention is to provide a heating device, in accordance with the preceding objects, having a screen-type supporting shelf or retaining member along the lower edge of the newspapers through which combustion supporting air may pass and which retains the newspapers in position.

Still another important feature of the present invention is to provide a heating device which is quite simple in construction, easy to insert into a fireplace, easy to associate with a smokestack or chimney for use in a free-standing mode and efficiently burns old newspapers to provide effective heating of a living space and persons occupying the same especially when the heat requirements are relatively small or the time duration of the heat requirements is relatively short although the heat supplying characteristics of the device may be prolonged by inserting additional newspapers into the heating device.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
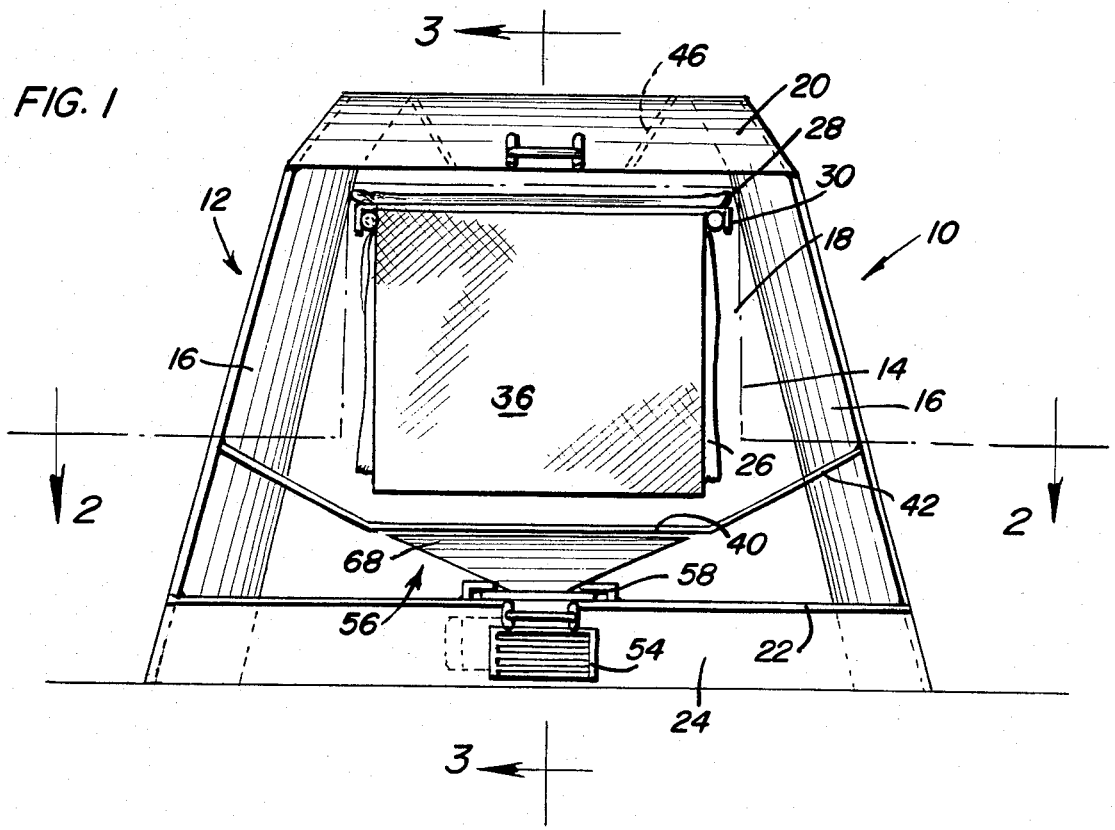
FIG. 1 is a front elevational view of the heating device of the present invention.
Figure 2:
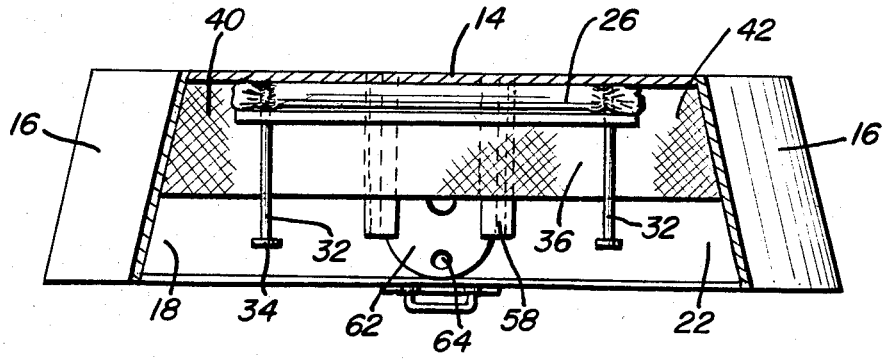
FIG. 2 is a transverse sectional view taken substantially upon a plane passing along section line 2—2 of FIG. 1.
Figure 3:
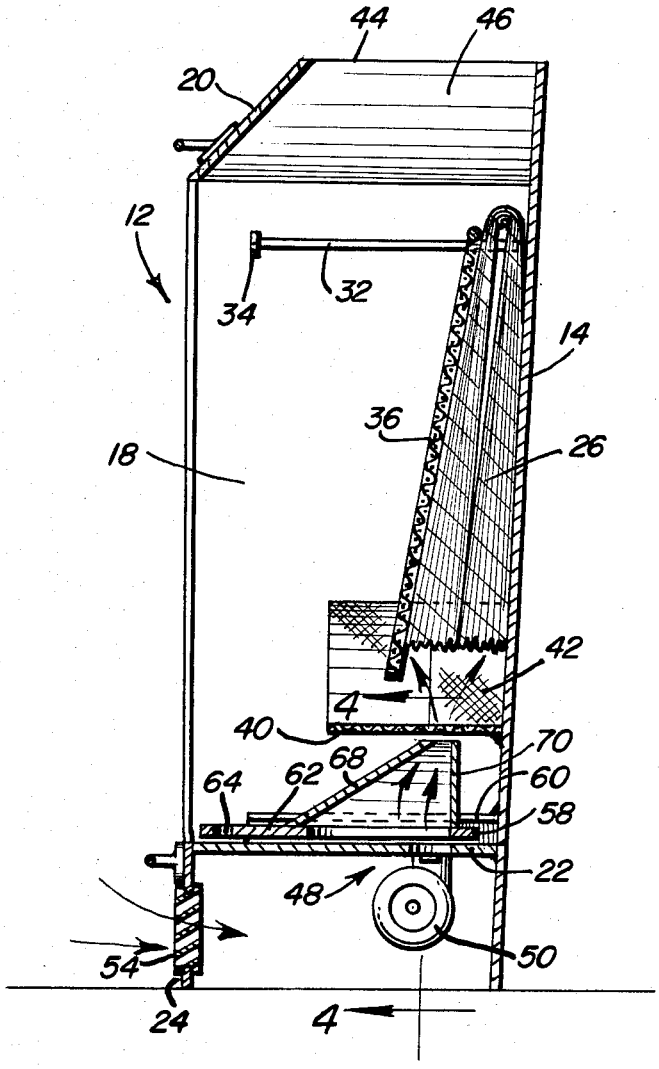
FIG. 3 is a vertical sectional view taken substantially upon a plane passing along section line 3—3 of FIG. 1.

Referring now specifically to the drawings, the heating device of the present invention is generally designated by reference numeral 10 and includes a generally vertically oriented housing 12 having a rear wall 14 which is inclined rearwardly, as shown in FIG. 3 and provided with upwardly converging side edges to which forwardly extending side walls 16 are connected, with the side walls 16 diverging forwardly. The front of the housing is open as indicated by numeral 18 with the top edge of the opening being defined by a partial top wall 20 connected to the upper ends of the side walls 16 and inclined rearwardly as illustrated in FIG. 3. The bottom of the opening 18 is defined by a bottom wall or partition 22 and extending downwardly from the forward edge of the partition 22 is a partial front wall 24 that is connected to the lower edge portions of the side walls 16 as illustrated in FIG. 1, thus providing a open front area defined by the side walls 16, the bottom wall or partition 22 which is disposed above the lower edges of the back wall and side walls and the partial front wall 20 for receiving generally vertically disposed, folded newspapers 26 which are supported between a pair of generally horizontally disposed supporting rods 32 which are fixedly secured to the rear wall 14 in any suitable manner and provided with slightly enlarged stop members 34 at the forward ends thereof which are located inwardly of the front side edges of the side walls 16 as illustrated in FIG. 3. The rods 32 are spaced apart less than the width of the folded newspapers 26 and actually deform and grip the side edges of the newspapers adjacent the upper corners thereof as at 28. Also supported on the rods 32 for movement toward and away from the newspapers 26 is a screen mesh member 36 which may be in the form of an expanded metal member, metal lathe member, or the like, which is of relatively heavy metal construction and provided with relatively large openings. The rods 32 are received in openings adjacent the corners of the screen mesh member 36 so that the screen member 36 may move toward and away from the newspapers 26 by using a poker or other suitable instrument with the stop members 34 preventing the screen mesh member 36 from being inadvertently pulled off the front ends of the rods 32.

Positioned under the newspapers 26 is a shelf member 40 also in the form of a wire mesh having upwardly inclined end portions 42 connected with the side walls 16 and also connected with the rear wall 14 which serves to retain any ash or residue from the newspapers in the area of the housing so that any material which may drop from the newspapers as they burn will be completely consumed and discharged from the open top of the housing which opening is defined by numeral 44 and includes baffles 46 therein extending from the rear wall 14 to the partial front wall 20. The entire device may be inserted in a fireplace opening and is of a size to fit within conventional fireplace openings with the opening 44 in alignment with the chimney so that combustion products including any ash material will be discharged from the fireplace into the atmosphere through the usual chimney. Likewise, a smokestack may be attached to the top end of the housing or a chimney associated therewith so that the device may be used in a free-standing mode either outside on a patio or the like for cooking foods, such as barbecueing meat and the like, or the device may be used in a room or the like when provided with appropriate chimney or smokestack associated therewith which communicates with the atmosphere.

Figure 4:
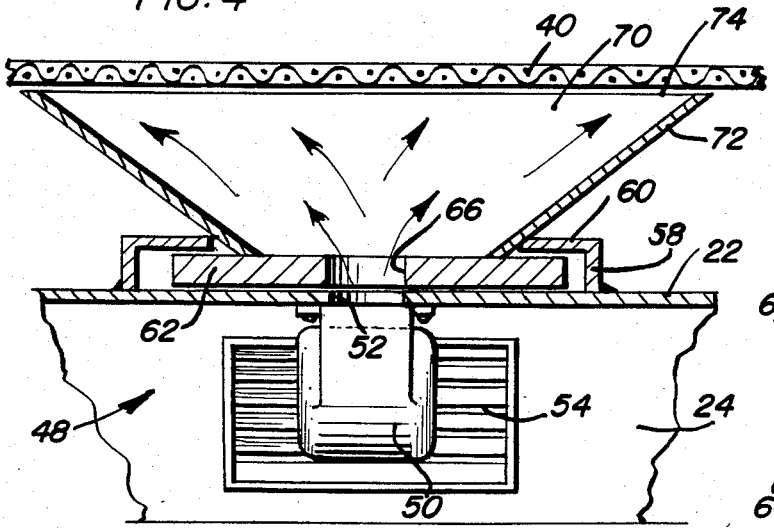
FIG. 4 is a sectional view, on an enlarged scale, taken substantially along section line 4—4 of FIG. 3, illustrating the relationship of the forced air draft fan and air diffuser.
Figure 5:
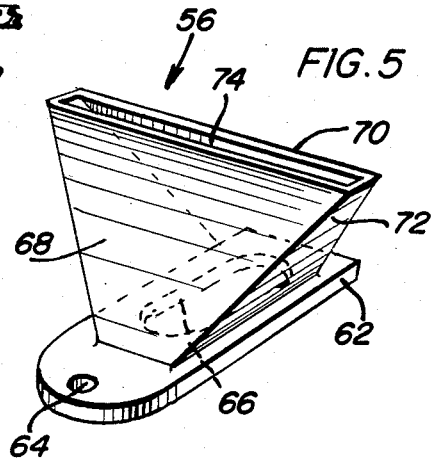
FIG. 5 is a perspective view of the air diffuser.

A forced air draft device generally designated by the numeral 48 is provided below the screen shelf 40 and includes a fan and motor assembly 50 having a discharge through an aperture 52 in the partition 22 as illustrated in FIG. 4 with the front wall 24 including a louvered opening 54 to admit air to the fan 50. The fan and motor unit may be manually controlled or thermostatically controlled or of variable speed, if desired, and discharges air through the opening 52 into the area under the screen shelf 40 with the fan unit being supported from the partition 22 in a conventional manner. To control and diffuse the airflow, a diffuser generally designated by the numeral 56 is supported on top of the partition 22 by a pair of front-to-rear track members 58 having inwardly extending spaced flanges 60 slidably receiving a bottom plate 62 on the diffuser 56 for front-to-rear movement with the plate 62 including a small aperture 64 at the forward end for receiving the hook end of a poker or the like to enable the diffuser to be moved inwardly or outwardly. The plate 62 is also provided with an elongated opening 66 therein for registry with the opening 52 as the plate 62 moves inwardly and outwardly. Extending upwardly from the plate is a transition member including upwardly converging forward and rear walls 68 and 70 in which the rear wall 70 is substantially vertically disposed. Upwardly diverging side walls 72 interconnect the front and rear walls 68 and 70 and terminate at their upper edges in an elongated slot 74 for discharging air upwardly through a substantial horizontal portion of the screen 40 with inward and outward movement of the diffuser 56 determining the position of the air concentration in relation to the lower edges of the newspapers 26.

When newspapers approximately one-half inch thick are placed in the housing rest against the rearwardly slanted rear wall 14 with the screen member 36 against the forward surface of the newspapers, the lower edges thereof may be ignited in a conventional manner and it is not necessary for the combustion supporting air fan to be energized at that time. By moving the screen member 36 inwardly and outwardly, the rate of combustion of the newspapers may be controlled so that rather than an open fast burning flame being produced, the newspapers will be converted to a carbon-like material which will burn slowly to produce substantial radiant heat, thus controlling the rate of combustion and efficiently utilizing the heat produced by burning the newspapers. After an initial burning period, the fan may be actuated and moved inwardly or outwardly to control the rate of burning and concentrate the burning at a desired area of the newspapers. Also, during the burning operation, the screen member 36 is moved inwardly and outwardly to more or less compress the newspapers to retard burning and enable more combustion supporting air to pass thereover to increase burning. As the side edges of the newspapers burn and screen member 36 is moved outwardly, the partially burned and charred newspaper will fall downwardly onto shelf 40 so that air from the fan will more effectively support combustion of the entire newspaper. It has been found that a quantity of newspapers approximately one-half inch thick will burn for a period of 20 to 30 minutes and substantially all the newspapers will be consumed and very little, if any, residue will remain within the housing and the newspapers will produce adequate heat, especially when the heating requirements are relatively low, such as when it is desired to heat a living space for a short period of time without charging a fireplace with wood, or the like. It has been observed that the newspaper increases substantially in volume, approximately twelve times, during combustion due to the individual sheets curling, wrinkling and the like which enhances the complete combustion of the newspapers, increases the volume thereof and controls the rate of combustion. By replenishing the newspapers, the length of operation may be prolonged as desired and the device may be utilized with food supports in the opening or associated with the opening in any manner or associated with the housing in any manner for effectively cooking various food items. In situations where the heating device is used outdoors, on the patio or the like, and electricity for the fan motor may not be available, a horizontal supporting rod may be inserted through the newspaper fold with the ends, which may be turned downwardly, being slidably supported on the rods 32. This supports the newspaper and prevents it from falling downwardly so that the natural draft will more effectively provide combustion supporting air to the newspaper. Also within the purview of this invention is the provision of an outer shell for all or part of the housing which provides a heated air chamber with a circulating air fan associated therewith in a manner to take in cool air at the bottom and discharge heated air at the top thus enabling the device to be used effectively as a free standing room heater.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A heating device for consuming newspapers by converting them to a carbon-like material and burning this material at a controlled rate comprising a housing having an open top and an open front defined by wall members, support means for suspending folded newspapers in the housing, a screen means engaging the front surface of the newspapers to control combustion thereof and to retain the newspapers in assembled relationship in order to assure complete combustion of the newspapers and to utilize the heat produced thereby, a forced draft device associated with the lower portion of the housing and newspapers supported thereon, a screen means extending below the newspapers supported in the housing and above the forced draft device, said forced draft device including a movable diffuser located below the screen means below the newspapers to supply air along a horizontally elongated area under the supported newspapers, said means supporting folded newspapers including a pair of generally horizontally disposed support rods supported in the housing and including free forward ends, said support rods engaging and deforming the side edges of a folded newspaper disposed between the support rods with the free lower edges thereof adjacent the screen means.

2. The structure as defined in claim 1 wherein said means controlling combustion of the newspapers includes a wire mesh member of substantially rigid construction having openings therein slidably supported on the support rods and engaging the front surface of the newspapers to control the rate of combustion thereof with the wire mesh member having a dimension substantially equal to the dimensions of the newspapers.

3. The structure as defined in claim 2 wherein said housing has an opening at the upper end thereof for registry with a fireplace chimney with the housing being of a size to be moved into a conventional fireplace opening for use of the device in a fireplace.

4. The structure as defined in claim 2 wherein said housing has an opening in the upper end thereof for connection with a smokestack or chimney to enable it to be utilized in a free-standing mode.

5. A heating device for insertion into a fireplace comprising a housing having an open front for receiving folded newspapers in a generally vertical position, a perforated member engaging and covering a substantial portion of the front surface of the newspapers, means adjustably supporting the perforated member from the housing for movement toward and away from the newspapers to control access of air thereto for controlling the rate of combustion, the upper end of said housing having an outlet for exhausting combustion products, forced air supply means below the newspapers and discharging combustion supporting air upwardly through a horizontal perforated member along a substantial portion of the lower edge of the newspapers.

6. The heating device of claim 5 wherein said air supply means includes a fan and motor supported below the horizontal perforated member and discharging air into a distribution device below the horizontal perforated member.

* * * * *